US005949461A

United States Patent [19]

Jones et al.

[11] Patent Number: 5,949,461

[45] **Date of Patent: *Sep. 7, 1999**

[54] INK REFILL BOTTLE

[75] Inventors: Bruce S. Jones; William Allen Putman, both of Franklin; Cecelia Dawn Moore, Murfreesboro, all of Tenn.

[73] Assignee: Nu-kote Imaging International, Inc., Franklin, Tenn.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/198,944

[22] Filed: Feb. 18, 1994

[51] Int. Cl.[6] ..... B41J 2/175

[52] U.S. Cl. ..... 347/87

[58] Field of Search ..... 347/86, 85, 87

[56] References Cited

U.S. PATENT DOCUMENTS

| | | | |
|---|---|---|---|
| 4,183,031 | 1/1980 | Kyser et al. | 347/86 |
| 4,347,524 | 8/1982 | Engel et al. . | |
| 4,368,478 | 1/1983 | Koto | 347/86 |
| 4,635,073 | 1/1987 | Hanson . | |
| 4,680,859 | 7/1987 | Johnson . | |
| 4,683,481 | 7/1987 | Johnson . | |
| 4,771,295 | 9/1988 | Baker et al. . | |
| 4,794,410 | 12/1988 | Taub et al. . | |
| 4,794,411 | 12/1988 | Taub et al. . | |
| 4,812,859 | 3/1989 | Chan et al. . | |
| 4,827,294 | 5/1989 | Hanson . | |
| 4,862,197 | 8/1989 | Stoffel . | |
| 4,872,027 | 10/1989 | Buskirk et al. . | |
| 4,931,811 | 6/1990 | Cowger et al. . | |
| 4,931,814 | 6/1990 | Yoshimura | 347/86 |
| 4,967,207 | 10/1990 | Ruder | 347/7 |
| 5,025,271 | 6/1991 | Baker et al. . | |
| 5,108,503 | 4/1992 | Hindagolla et al. . | |
| 5,116,409 | 5/1992 | Moffatt . | |
| 5,119,115 | 6/1992 | Buat et al. | 347/86 |
| 5,162,817 | 11/1992 | Tajika et al. | 347/7 |
| 5,182,581 | 1/1993 | Kashimura et al. | 347/87 |
| 5,329,294 | 7/1994 | Ontawar et al. . | |
| 5,329,304 | 7/1994 | Koizumi et al. . | |
| 5,329,305 | 7/1994 | Fukushima et al. . | |

FOREIGN PATENT DOCUMENTS

| | | | |
|---|---|---|---|
| A560729 | 9/1993 | European Pat. Off. . | |
| 2032006 U | 7/1992 | Germany . | |
| 9300132 U | 6/1993 | Germany . | |
| 6-966 | 1/1964 | Japan | 347/86 |
| 61-35892 | 3/1986 | Japan . | |
| 3189162 | 8/1991 | Japan | 347/86 |
| 5-104735 | 4/1993 | Japan | 347/86 |
| 9318920 | 9/1993 | WIPO | 347/86 |

OTHER PUBLICATIONS

Pelikan Hardcopy; pp. 1–4, Mar. 1993.

*Primary Examiner*—N. Le
*Assistant Examiner*—Judy Nguyen
*Attorney, Agent, or Firm*—Fay, Sharpe, Beall, Fagan, Minnich & McKee

[57] ABSTRACT

An ink refill bottle for a modified inkjet printhead cassette which has a rear wall opening through which the refill bottle may be inserted comprises a front wall connected to a rear wall by sidewalls to form an ink reservoir chamber, a foam adaptor for drawing ink from the ink chamber when called for by the printhead cassette, and an air inlet metering device for metering air into the ink chamber to replace the ink drawn from the ink chamber and for retaining the remainder of the ink in the ink chamber.

16 Claims, 5 Drawing Sheets

INK REFILL BOTTLE

BACKGROUND OF THE INVENTION

1. Field of the Invention

The present invention relates to inkjet printhead cassettes for supplying ink to printers, and more particularly concerns a modified re-usable inkjet printhead cassette and a replaceable ink refill bottle for supplying ink to printing apparatus.

2. Description of the Prior Art

Presently, inkjet printhead cassettes are used once and when the ink runs dry, the cassette is discarded. This is costly and wasteful.

Accordingly, in order to avoid this wastefulness it has been suggested to modify the empty inkjet printhead cassette so that it may be re-used. This is accomplished by removing the rear wall of the printhead cassette and adding an ink refill bottle.

One of the problems with modifying inkjet printhead cassettes for re-use is that while many of such cassettes are made with foam elements in reservoir chambers for holding the ink, several manufacturers make cassettes which have a liquid ink reservoir without the foam element. In other words, some manufacturers of inkjet cassettes have omitted the foam element from the ink reservoir and have changed to a liquid ink reservoir. This change eliminates the costly foam element and allows a higher yield of ink, as the foam element displaced a large volume of ink.

SUMMARY OF THE INVENTION

An object of the present invention is to overcome the problems of the prior art and to provide ink refill bottles having an ink reservoir with a foam element , or having a liquid ink reservoir without a foam element, which bottles are adapted for use with used modified printhead cassettes.

It is another object to provide a combination of ink refill bottle and modified used inkjet printhead cassette.

The present invention involves removing the rear wall from used inkjet printhead cassettes, adding an ink refill bottle to the empty cassette, and providing a needle-nozzle assembly that has an open cell foam wick to draw the ink from the ink bottle by capillary action and to meter the ink being drawn from the ink bottle to the printhead of the modified inkjet printhead cassette.

The new needle-nozzle assembly is an adaptor that connects the empty printhead cassette casing to the ink refill bottle. The ink refill bottle is blow molded and has a rubber seal on its front wall that connects with the needle-nozzle assembly in the modified printhead cassette casing, and has an air metering input device that is mounted in the rear wall of the blow molded bottle to admit air to replace the ink being drawn from the bottle and also retain the ink in the bottle and prevent it from escaping or leaking out through the air input device.

DETAILED DESCRIPTION OF THE DRAWINGS

Figure 1:
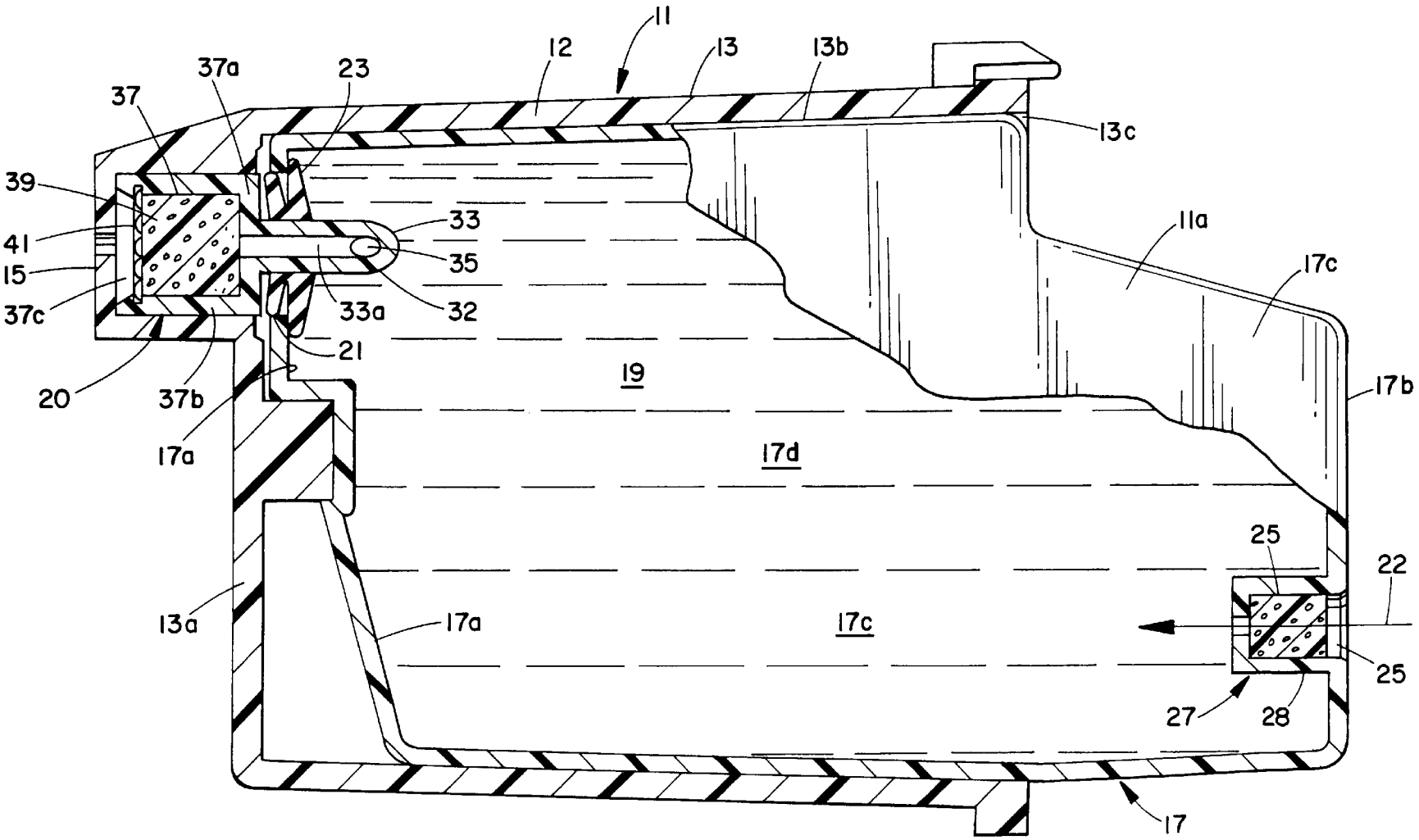
FIG. 1 is a view in vertical section of an ink refill bottle assembly constructed in accordance with this invention and shows a modified inkjet printhead cassette casing holding an ink refill bottle.
Figure 3:
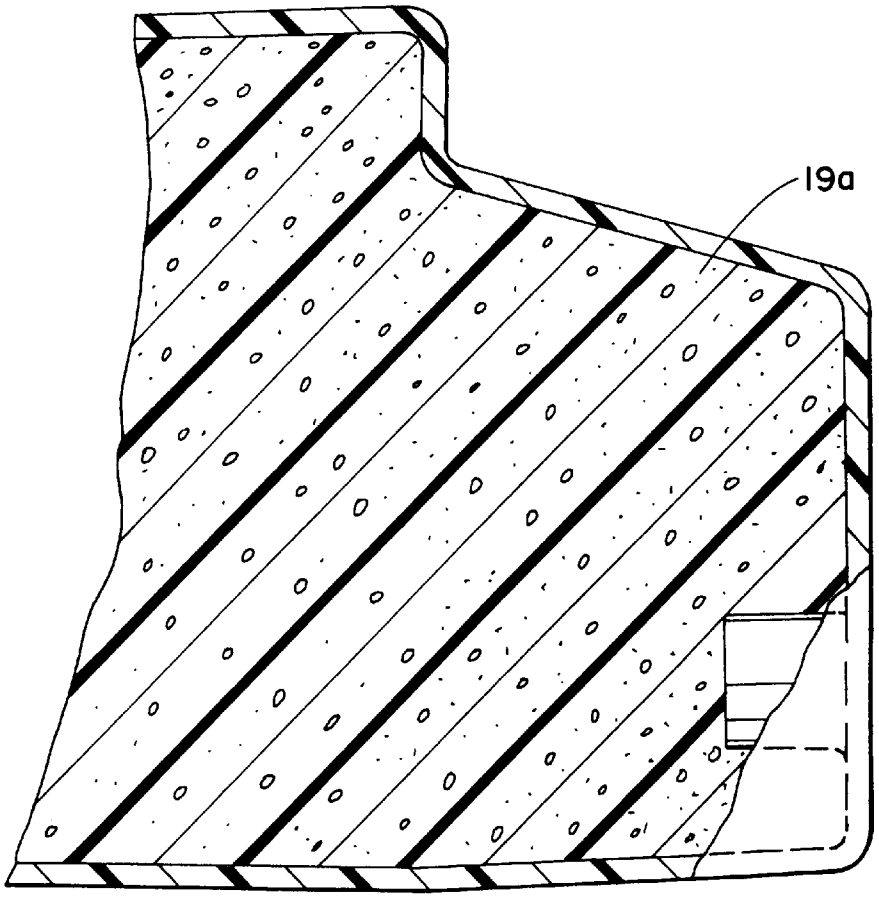
FIG. 3 is a partial view of another embodiment of an ink refill bottle showing an ink impregnated foam element in the bottle.

Turning now to the drawings, there is shown an ink refill bottle assembly 11 for a modified inkjet printhead cassette 12 which has a modified casing 13 with a front wall 13*a* and side walls 13*b* extending from the front wall 13*a* to a rear wall opening 13*c* through which a refill bottle 11*a* may be inserted into the modified inkjet printhead cassette casing 13. A printhead 15 is mounted on the front wall 13*a* of the inkjet printhead cassette casing 13.

The ink refill bottle 11*a* comprises an ink refill bottle housing 17 which has a front wall 17*a* connected to a rear wall 17*b* by sidewalls 17*c* to form an ink reservoir chamber 17*d* which may contain just liquid ink 19, or may contain an ink impregnated foam element 19*a*. Bottle 11 in FIG. 1 contains liquid ink 19. Ink exit means 20 are provided on the front wall 17*a* for discharging the ink 19 from the bottle 11*a*, and air input and ink retention means 22 are provided on the rear wall 17*b* for metering air into the bottle housing 17 to replace the ink 19 being withdrawn from the bottle 11*a* and retain the remainder of the ink 19 in the bottle.

The ink exit means 20 comprises an exit hole 21 formed in the front wall 17*a* of the bottle housing 17, and a seal plug 23 mounted in exit hole 21 for holding the ink 19 inside the bottle housing 17.

The air input and ink retention means 22 is located in rear wall 17*b* of the bottle housing 17 and comprises an input hole 25 formed in the rear wall 17*b*, and in FIG. 1 a foam cylinder 27 mounted in a compartment 28 extending forwardly from input hole 25 for metering air into the bottle housing 17.

Figure 2:
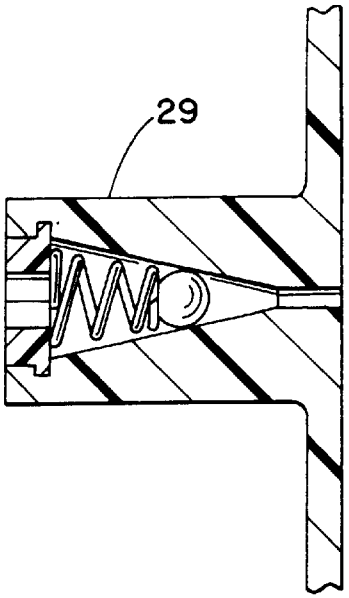
FIG. 2 is a view in vertical section of an alternative mechanical one-way metering valve which may be mounted in the rear wall of the bottle housing for metering air into the ink bottle and for retaining the ink in the bottle.
Figure 5:
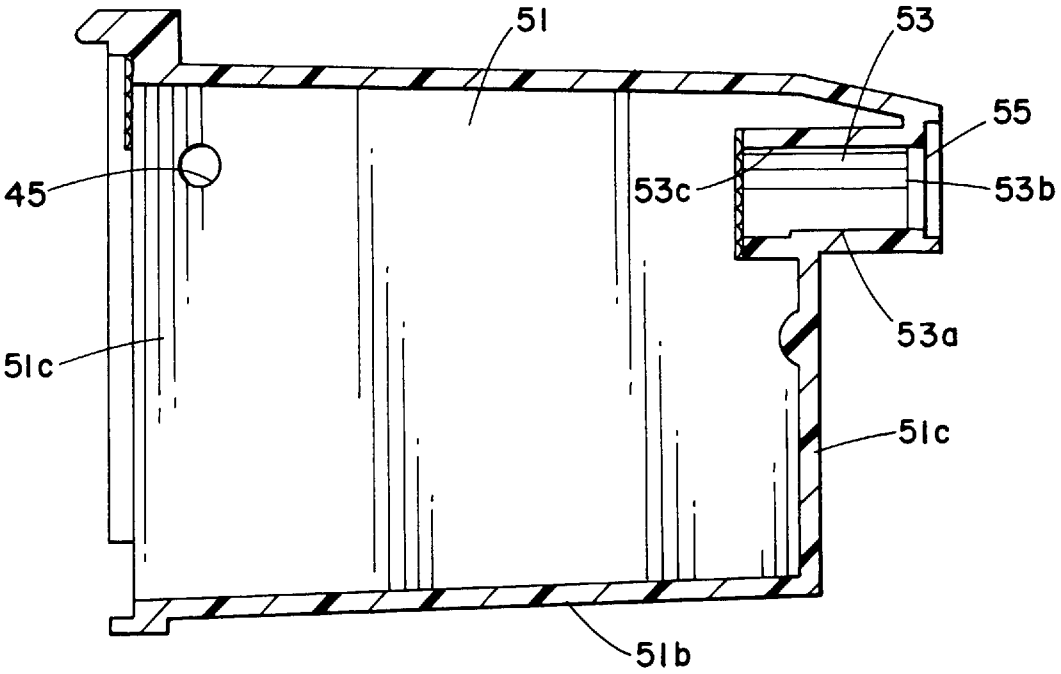
FIG. 5 is a side view in vertical section of the inkjet printhead cassette casing of FIG. 3.
Figure 4:
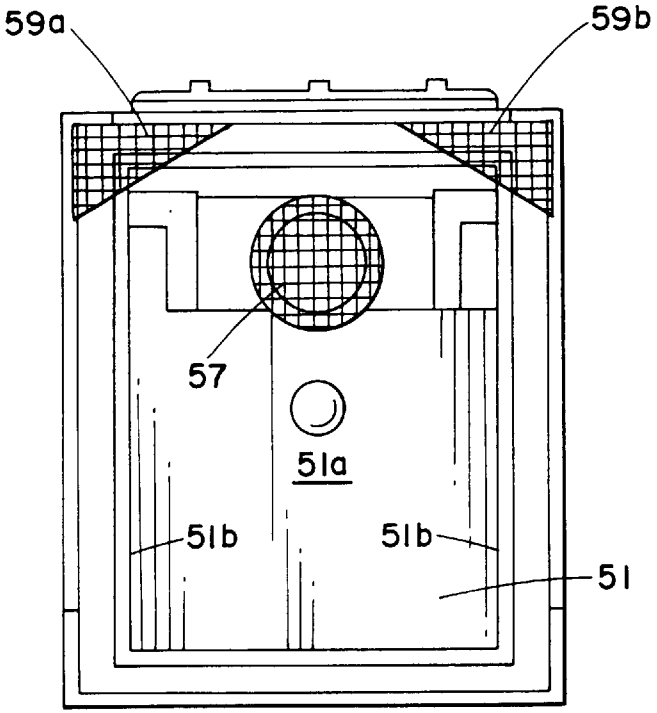
FIG. 4 is a view in rear elevation of an inkjet printhead cassette casing in the process of being modified in accordance with this invention.
Figure 6:
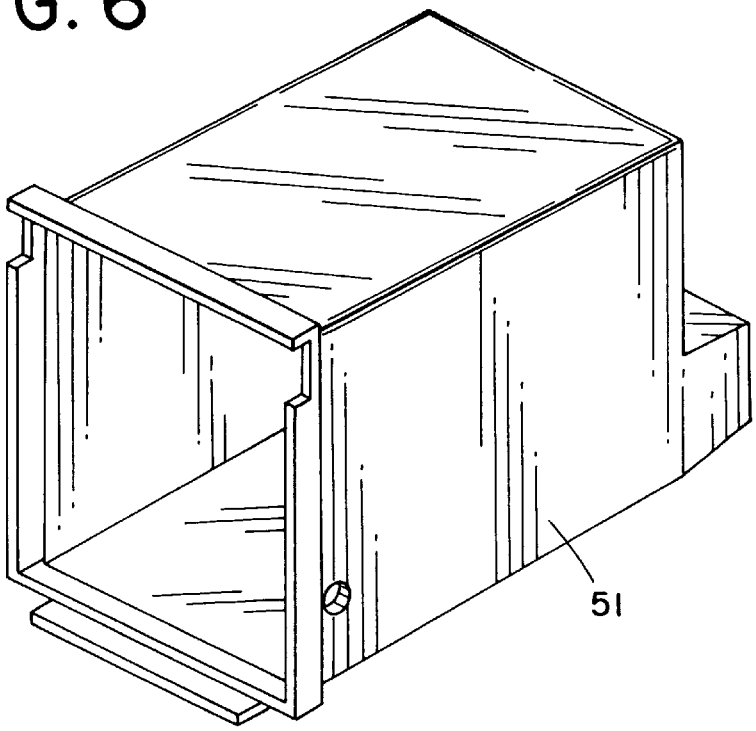
FIG. 6 is a view in perspective of the inkjet printhead cassette casing of FIG. 4 looking from side and rear. of the casing.
Figure 7:
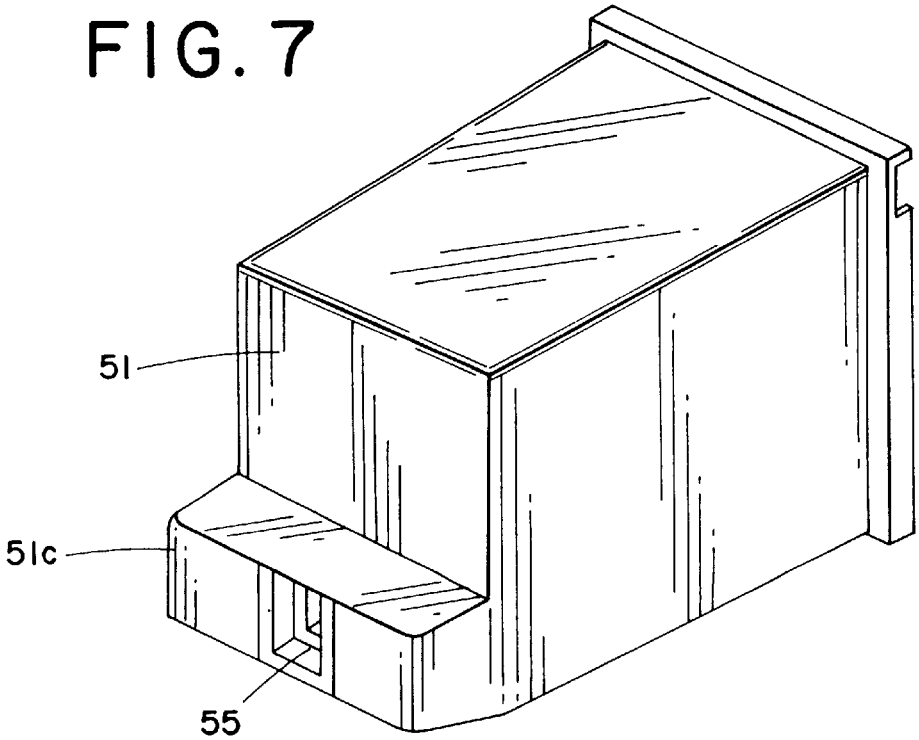
FIG. 7 is a view in perspective of the inkjet printhead cassette casing of FIG. 4 looking from the side and front of the casing.

Alternatively, as shown in the embodiment of FIG. 2, a mechanical one-way metering valve 29 may be substituted for the foam cylinder 27.

The modified inkjet printbead cassette 12 also includes an adapter, needle-nozzle means 32, mounted on the front wall 13*a* of the casing 13. Needle-nozzle means 32 is inserted through the ink exit means 20 in front wall 17*a* of bottle housing 17 for transmitting ink 19 from bottle 11*a* to the printhead 15. The needle-nozzle means 32 has a needle-like rear portion 33 which is inserted through the seal plug 23 into the ink 19 in ink refill bottle casing 13. Needle-nozzle rear portion 33 includes a hollow bore 33*a* with an oblong needle hole 35 formed in the sidewall of needle-nozzle-like rear portion 33 that receives the ink 19 from bottle housing 17.

The needle-nozzle means 32 also includes a wick chamber 37 that extends forwardly from the needle-like rear portion 33. The wick chamber 37 has a rear wall 37*a* and side walls 37*b* which extend forwardly to a front opening 37*c*. A foam wick 39 is positioned in wick chamber 37 to draw the ink 19 from the ink chamber 17*d* of bottle 11*a* by capillary action, and a screen 41 is mounted across the front opening 37*a* of the wick chamber 37 to keep any large ink particles from passing through from ink reservoir 17*a* and clogging up the printhead 15.

The side walls 13*b* of cassette casing 13 and the side walls 17*c* of bottle housing 17 are provided with detent means for assuring proper placement and retention of the ink bottle 11*a* in the printhead casing 13. The detent means comprises locking projections 43 which are mounted on the side walls of the ink refill bottle, and locking holes 45 which are formed in the side walls of the modified ink jet printhead cassette casing.

In operation, the locking projections 43 snap into locking holes 45 with a click to properly position the ink bottle in the printhead casing and retain the ink bottle 11*a* in the proper position. The click can be heard by the person inserting the ink bottle to give assurance that the insertion has been done properly.

FIGS. 4–7 show a step in the process of modifying inkjet printhead cassette casing 51 which has a front wall 51*a*, and four side walls 51*b* extending rearwardly from front wall 51*a* to a rear wall opening 51*c*.

A socket compartment 53 is formed in rear wall 51*a* and is cup-shaped and has sidewalls 53*a*, a front wall 53*b* and a rear wall opening 53*c*.

A printhead 55 is mounted in front wall 53*b* of socket 53, and a screen 57 is mounted across rear wall opening 53*c* of socket compartment 53. Two locking holes 45 are provided in casing 51 for receiving the locking projections of an ink refill bottle. Corner portions 59*a* and 59*b* of the rear cap of cassette casing 51 remain after the remainder of the rear cap has been removed from the cassette casing 51, and the corner portions 59*a* and 59*b* add rigidity and strength to the casing.

Figure 8:
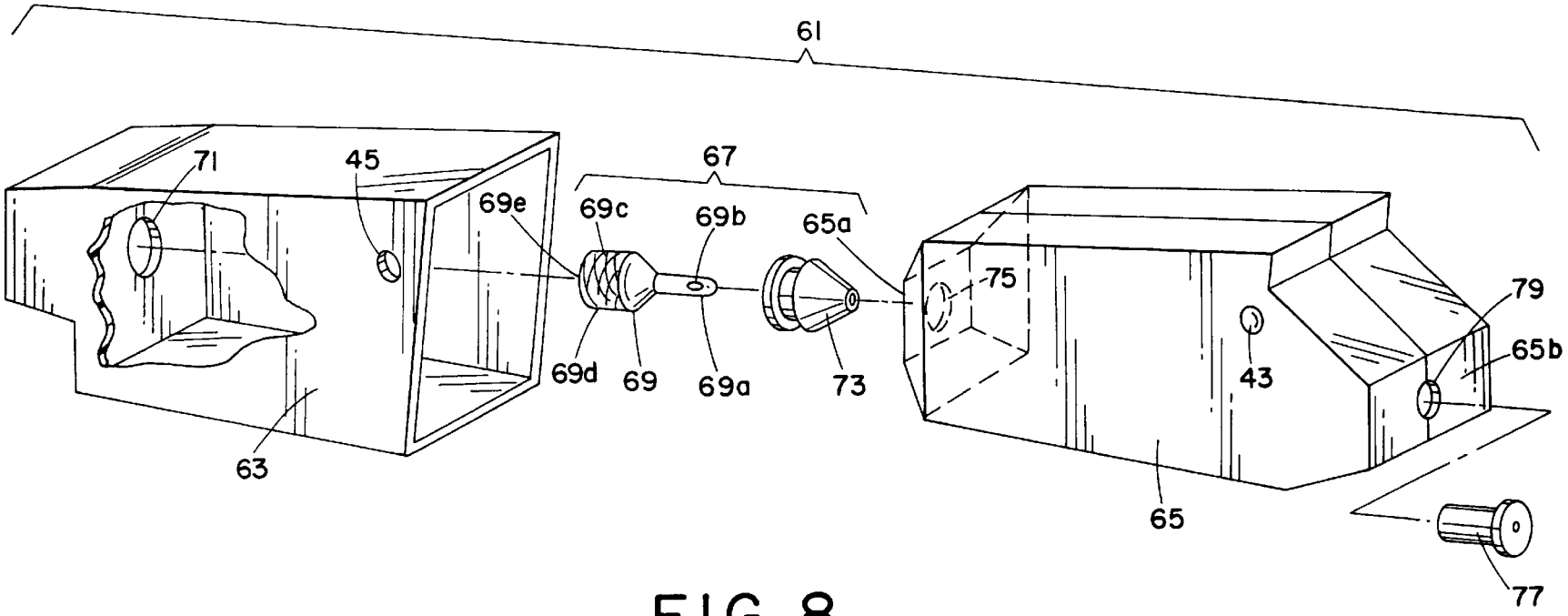
FIG. 8 is an exploded view in perspective of another embodiment of the modified inkjet printhead cassette assembly constructed in accordance with this invention.

FIG. 8 shows another embodiment of a modified inkjet printhead cassette 61 and illustrates the easy click concept of providing a modified inkjet printhead cassette casing 63, an ink refill bottle 65, and an adaptor 67 which includes a molded needle-nozzle 69 that has a hollow needle-like portion 69*a*, a needle hole 69*b*, a screen 69*c*, a foam wick 69*d*, and a bore 69*e*. Needle-nozzle 69 fits inside a hole 71 formed in the front 63*a* of the cassette casing 63 and is inserted into bottle 65 through plug 73, which may be made of silicone rubber, mounted in hole 75 in front wall 65*a* of ink refill bottle 65.

The needle-nozzle 69 has its needle-like portion 69*a* inserted through plug 73 into the interior of ink refill bottle 65. A one-way valve 77 is mounted in a hole 79 in bottle rear wall 65*b* to act as an air metering baffle to replace the ink drawn from the bottle with air and to retain the remainder of the ink in the bottle and prevent it from escaping.

The foam of foam cylinder 27 may be a reticulated polyester polyurethane open pore foam, tensile strength about 50–110 psi, ultimate elongation about 250–350%, tear strength about 5–18 lb/inch, about 90 pores per linear inch, and may be obtained from Scotfoam, Eddipilone, Pa. as their catalog number 4-900Z. The permeability of the foam at 0.5 in. of water pressure equals about 65–200 cfm/sq.ft. using test procedure ASTM D3574.

The wick material for wick 39 is preferably Porex XN-1304 polyurethane foam with air flow of 900–2500 in/min at an inlet pressure of 1.2 inch (water) and may be obtained from Porex Technologies Corp., P.O. Box 100394, Atlanta, Ga. 30384.

We claim:

1. A method of converting an ink jet print head casing which includes an integral ink jet print head and a non-replaceable ink reservoir to be capable of accepting a replaceable ink refill bottle, the method comprising the steps of:

providing an ink jet print head casing having an integral ink jet print head and a non-replaceable ink reservoir for containing ink, the print head casing including a fluid passage for communicating ink between the ink reservoir and the ink jet print head;

providing a replaceable ink refill bottle containing refill ink and including an ink exit;

removing a portion of the casing to receive the replaceable ink refill bottle within the non-replaceable ink reservoir; and attaching an adapter to the ink jet print head casing for operatively connecting the fluid passage to the replaceable ink refill bottle, the adapter including a needle-nozzle adapted for insertion into the ink exit of the replaceable ink refill bottle for establishing fluid communication between the replaceable ink refill bottle and the ink jet print head.

2. The method as set forth in claim 1 further including providing a foam wick within the adapter for drawing ink from the replaceable ink refill bottle by capillary attraction and supplying the ink to the ink jet print head.

3. The method as set forth in claim 1 further including retaining the refill ink within the replaceable ink refill bottle by a foam member disposed therein.

4. The method as set forth in claim 1 further including disposing a seal plug within the ink exit of the replaceable ink refill bottle for sealingly connecting the ink exit and the adapter when the replaceable ink refill bottle is inserted into the ink jet print head casing.

5. The method as set forth in claim 1 further including filtering ink which passes through the adapter.

6. The method as set forth in claim 1 further including providing detents on the ink jet print head casing for retaining the ink refill bottle once received therein.

7. The method as set forth in claim 1 further including metering air into the ink refill bottle to replace ink discharged from the bottle.

8. The method as set forth in claim 1 further including connecting the replaceable ink refill bottle to the adapter such that the replaceable ink refill bottle is disposed within the non-replaceable ink reservoir.

9. The method as set forth in claim 1 wherein the removing a portion step is performed before the providing step.

10. A method of making a reusable printhead cassette from a printhead cassette having a casing defining a non-replaceable ink reservoir and a printhead attached thereto, the method comprising:

removing a portion of the casing to provide access to the non-replaceable ink reservoir;

providing ink refill bottle;

attaching an adapter within the casing between the printhead and the ink reservoir, the adapter defining a fluid path to the printhead and adapted for removable connection to the ink refill bottle;

inserting the ink refill bottle into the non-replaceable ink reservoir, the ink refill bottle including a supply of ink; and connecting the ink refill bottle to the adapter for establishing fluid communication of ink between the ink refill bottle and the printhead.

11. The method as set forth in claim 10 further including providing a hollow needle projecting outwardly from the adapter and being in fluid communication with the fluid path, the hollow needle adapted for insertion into the ink refill bottle.

12. The method as set forth in claim 10 further including disposing a capillary element within the adapter.

13. The method as set forth in claim 10 further including metering air into the ink refill bottle to replace ink supplied to the printhead.

14. The method as set forth in claim 10 further including filtering the ink supplied from the ink refill bottle.

15. The method as set forth in claim 10 further including engaging the ink refill bottle and the casing to retain the ink refill bottle therein.

16. The method as set forth in claim 10 wherein the engaging includes providing detents on the casing for engaging the ink refill bottle inserted therein.

* * * * *